US007481594B2

(12) United States Patent
Martin

(10) Patent No.: US 7,481,594 B2
(45) Date of Patent: Jan. 27, 2009

(54) WEIGHTED SCRUB BRUSH

(75) Inventor: Michael B. Martin, Harris County, TX (US)

(73) Assignee: MB Manufacturing, Kemah, TX (US)

( * ) Notice: Subject to any disclaimer, the term of this patent is extended or adjusted under 35 U.S.C. 154(b) by 270 days.

(21) Appl. No.: 10/805,833

(22) Filed: Mar. 22, 2004

(65) Prior Publication Data

US 2005/0207825 A1 Sep. 22, 2005

(51) Int. Cl.
*A46B 11/06* (2006.01)
*A47L 13/22* (2006.01)

(52) U.S. Cl. ..... 401/289; 401/268; 401/282

(58) Field of Classification Search ..... 401/268, 401/282, 286, 289; 15/49.1, 50.1, 321
See application file for complete search history.

(56) References Cited

U.S. PATENT DOCUMENTS 4,443,906 A * 4/1984 Tucker et al. ..... 15/50.1
4,542,551 A * 9/1985 Phillips ..... 15/49.1
4,542,556 A * 9/1985 Hepple ..... 15/321
5,477,578 A * 12/1995 Duncan et al. ..... 15/49.1
6,367,109 B1 * 4/2002 Besel et al. ..... 15/50.1

* cited by examiner

*Primary Examiner*—Tuan N Nguyen
(74) *Attorney, Agent, or Firm*—Browning Bushman, P.C.

(57) ABSTRACT

A weighted scrub brush has a brush head defining a leading end, a trailing end, a pair of laterally opposing ends, a downwardly facing bristle support surface, and an upwardly opening weight recess. A weight having first and second opposing ends is removably positioned within the weight recess. Mating support members support the first end of the weight, while a cantilevered support latch partially overlaps the second end of the weight to secure the weight within the weight recess. A conduit extends from a liquid intake port, through the handle, and to the brush head to dispense liquid from the conduit to the plurality of bristles. A roller is secured to a central body portion of the brush head forward of the handle, such that the brush head may be pivoted to a forward, inverted position to roll the brush.

7 Claims, 5 Drawing Sheets

WEIGHTED SCRUB BRUSH

FIELD OF THE INVENTION

The invention relates to a weighted scrub brush for scrubbing upwardly facing surfaces such as floors. More particularly, the weighted scrub brush has an improved weight fastening system and passes water and chemicals to the bristles for enhanced cleaning.

BACKGROUND OF THE INVENTION

Many types of businesses, especially restaurants, are faced with the daily problem of keeping their floors clean. A typical complication with this process is misuse of a conventional mop. Although mopping is routinely necessary, mopping actually contributes to grease build-up. Every time a mop is removed from a bucket of dirty water, grease and dirt are simply smeared back into the floor. As a conventional mop is dragged along a tiles edge, the edge actually scrapes the dirt and grease off the mop, leaving it in the grout between tiles. Over time, this cleaning procedure can cause more harm than good.

To offset the damage done by mopping, it is further necessary to scrub the floor on a regular basis. The scrubbing procedure is nearly impossible to do with a lightweight scrub brush. To scrub the floor, the user of the scrub brush must exert a force on the brush head. This force comes mainly from the user's back. Over a short period of time, the user's back and muscles become tired, reducing the force the user can exert, which makes this procedure ineffective. To make the scrubbing procedure more effective, some scrub brushes are weighted. The weight exerts a force on the scrub brush so the user does not have to.

One commercially successful design is marketed as THE HEAVYWEIGHT(™) brush. This brush includes a flat, encapsulated weight recessed into a replaceable, oversized brush head. The brush head includes larger diameter, stiffer bristles on the leading and trailing edges to minimize bending of interior bristles and to minimize bouncing of the brush as it is moved back and forth along a floor. The handle is pivotable for use by persons of different stature and for cleaning under tables and other low areas. The recessed weight is secured to the brush head via a threaded member extending vertically from the brush head, which is received in a through-hole in the weight. A pair of wheels are spaced apart along the upper, leading end of the brush head so the brush head may be pivoted forward and rocked onto the wheels for easy transportation to and from a storage location. To prevent pinched fingers, the brush head is recessed in the region of its pivotal connection with the handle, so that even when the handle is pivoted to its lowest point (approx. 90 degrees) there is space between the handle and brush head.

Despite the commercial success of the HEAVYWEIGHT brush, further improvement is provided by reference to the invention discussed herein.

SUMMARY OF THE INVENTION

A weighted scrub brush is used for scrubbing an upwardly facing surface such as a floor. A brush head defines a leading end, a trailing end, a pair of laterally opposing ends, a downwardly facing bristle support surface, and an upwardly opening weight recess. A plurality of bristles extends downwardly from the bristle support surface for contacting the upwardly facing surface. A weight having first and second opposing ends is removably positioned within the weight recess. A handle is pivotally secured to one of the weight and the brush head. Mating support members support the first end of the weight, while a cantilevered support latch partially overlaps the second end of the weight to secure the weight within the weight recess. A conduit extends from a liquid intake port, through the handle, and to the brush head to dispense liquid from the conduit to the plurality of bristles. A roller is secured to a central body portion of the brush head forward of the handle, such that the brush head may be pivoted to a forward, inverted position to roll the brush. Outer body portions extend laterally outwardly of the roller and are vertically lower than the central body portion to increase vertical clearance above the outer body portions.

The foregoing is intended to give a general idea of the invention, and is not intended to fully define nor limit the invention. The invention will be more fully understood and better appreciated by reference to the following description and drawings.

DETAILED DESCRIPTION OF THE PREFERRED EMBODIMENTS

Figure 1:
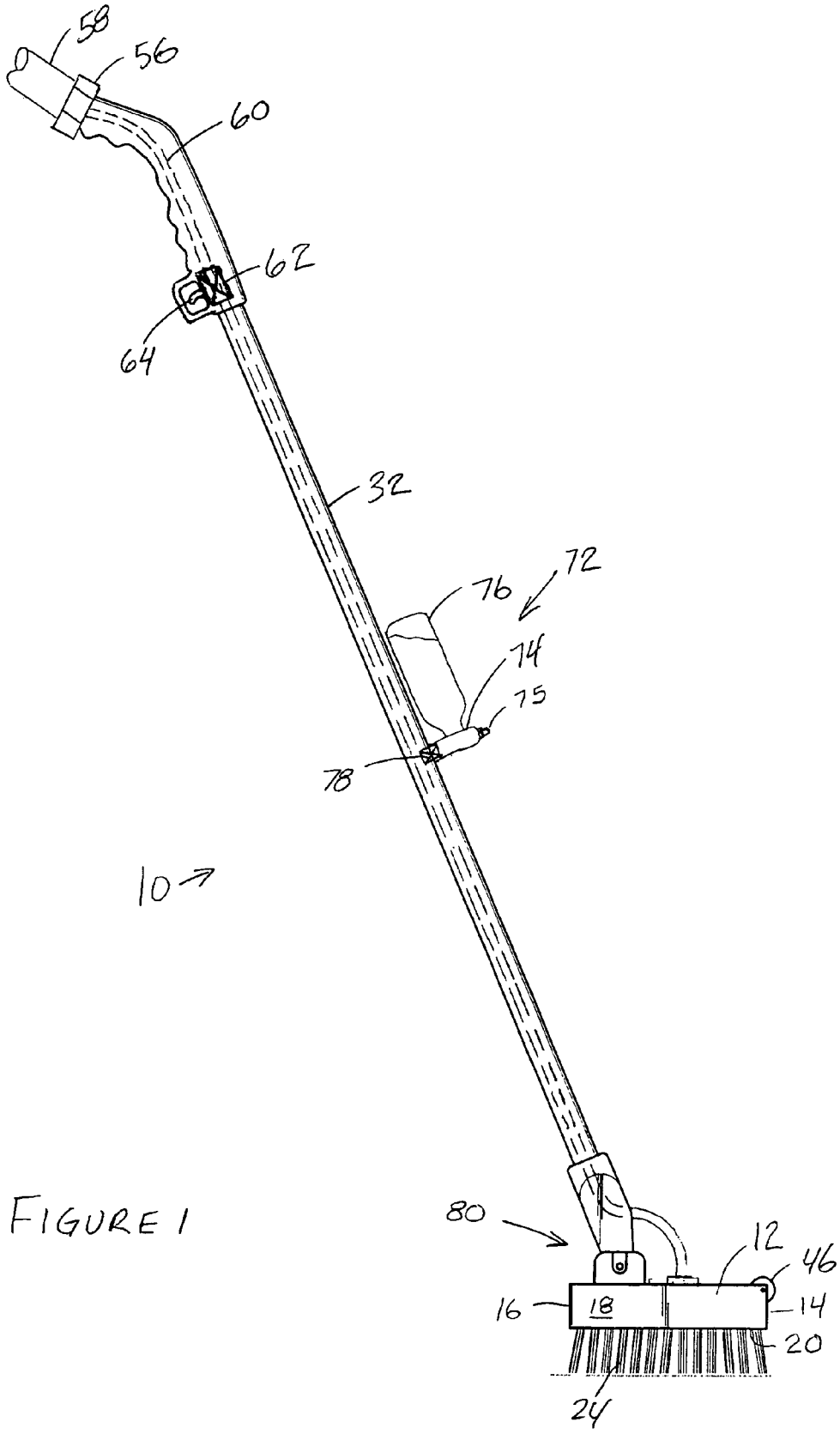
FIG. 1 shows a side view of the weighted scrub brush having a liquid input port and a chemical dispenser for passing a liquid such as water and chemicals such as soap to the bristles.

FIG. 1 shows a weighted scrub brush 10 for scrubbing an upwardly facing surface such as a floor 5. A brush head 12 (illustrated further in FIG. 2) has a leading end 14, a trailing end 16, a pair of laterally opposing ends 18, a downwardly facing bristle support surface 20, and an upwardly opening weight recess 22. A plurality of bristles 24 extends downwardly from the bristle support surface 20 for contacting and scrubbing the floor 5. A weight 26 is removably positioned within the weight recess 22, and has first and second opposing ends 28, 30. An elongate handle 32 is pivotally secured to the weight 26 with pivot structure 80. In other embodiments, the handle 32 may alternately be secured to the brush head 12.

A roller 46 allows easy transportation of the brush 10 by rolling, rather than by carrying. A roller 46 is secured to a central body portion indicated generally at 48 of the brush head 12 forward of the handle 32. The roller 46 radially extends upwardly and outwardly from the leading end 14 of the brush head 12, such that the brush head 12 may be pivoted to a forward, inverted position to roll the brush 10, as shown in FIG. 8.

Figure 2:
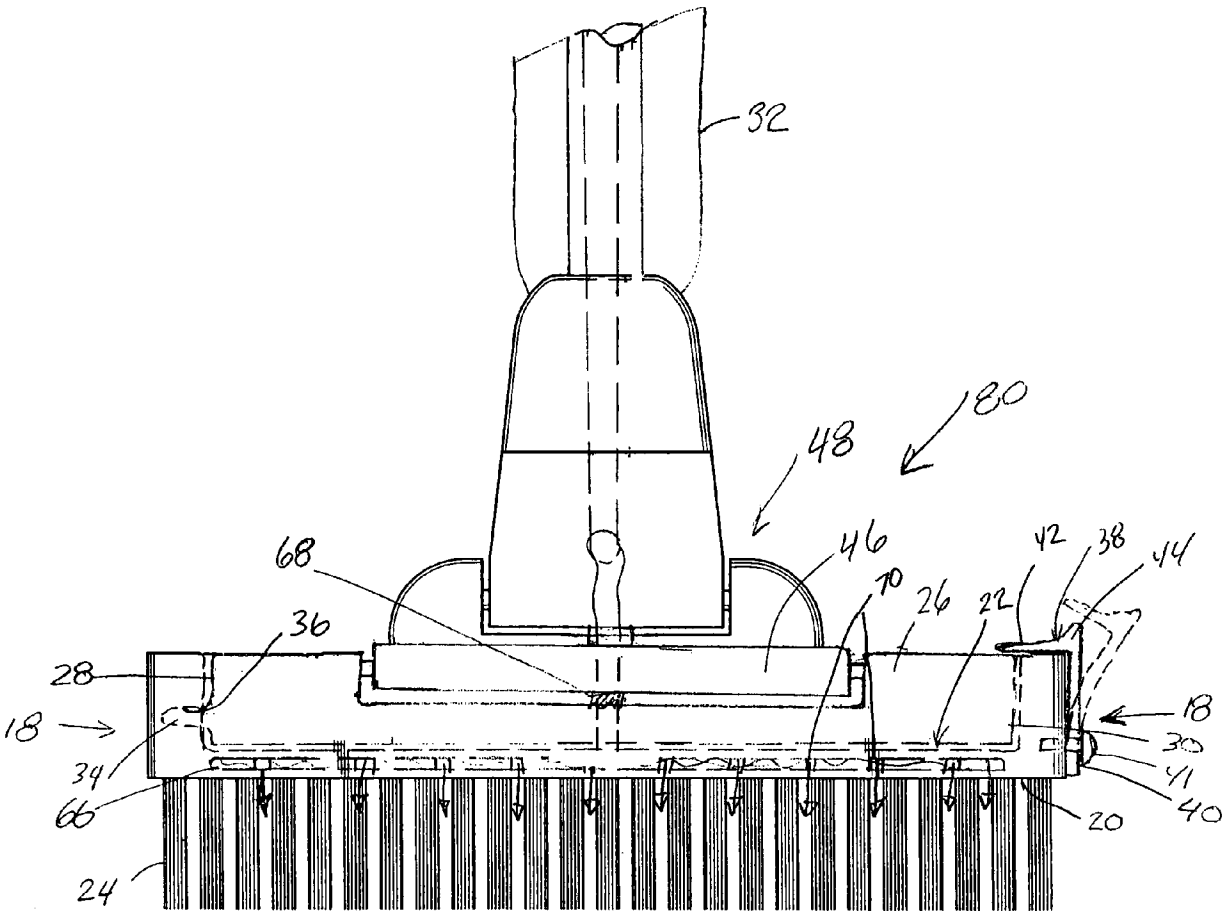
FIG. 2 shows a frontal view of the brush head of FIG. 1, into which a weight is recessed and retained with the male/female support members and cantilevered support latch placed adjacent laterally opposing ends.

Over time, the weighted scrub brush 10 will show signs of wear, especially with the bristles 24 and the roller 46 of the brush head 12. A particularly useful feature of the invention is the simplicity with which the weight 26 can be secured to the brush head 12, and later removed in order to replace the brush head 12. A male support member 34 is on the first end 28 of the weight 26, and a female support member 36 is on an interior wall 35 of the weight recess 22 for receiving the male support member 34, which secures the first end of the weight 26 within the weight recess 22. As shown, the male support member 34 comprises two support projections 34 laterally extending from the first end 28 of the weight 26, and the female support member 36 comprises two respective support recesses 36 laterally receding into the interior wall 35 of the weight recess 22. The recesses 36 may conveniently be drilled in the wall of the weight recess. As best shown in FIG. 2, a cantilevered support latch 38 has a fixed end 40 secured to the brush head 12 adjacent the second end 30 of the weight 22, and a free end 42 partially overlapping the second end 30 of the weight 26 to secure the second end 30 within the weight recess 22. The fixed end 40 may be secured with screw 41 or other conventional fastener. An engagement member 44 on the support latch 38 is spaced from the fixed end 40 for flexing the support latch 38 outwardly to move the free end 42 of the latch 38 away from the second end 30 of the weight 26 and remove the weight 26 from the weight recess 22. Thus, the male/female support members 34, 36 and the support latch 38 removably secure the weight 26 within the weight recess 22.

Figure 3:
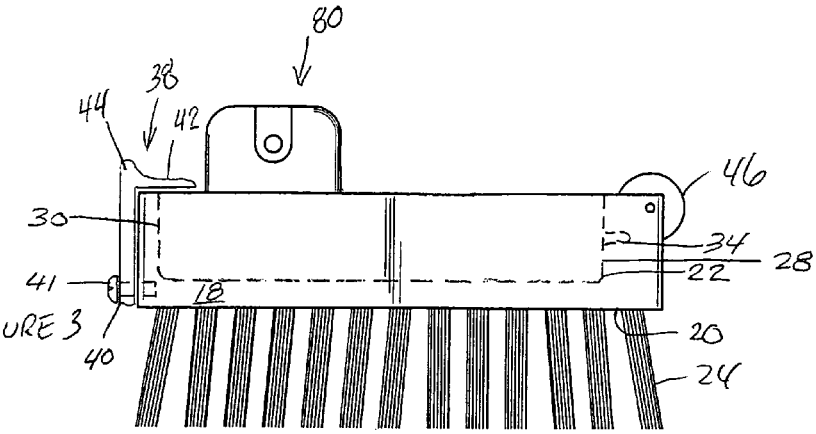
FIG. 3 shows a side view of the brush head, wherein the male/female support members and cantilevered support latch are instead placed adjacent leading and trailing ends.
Figure 4:
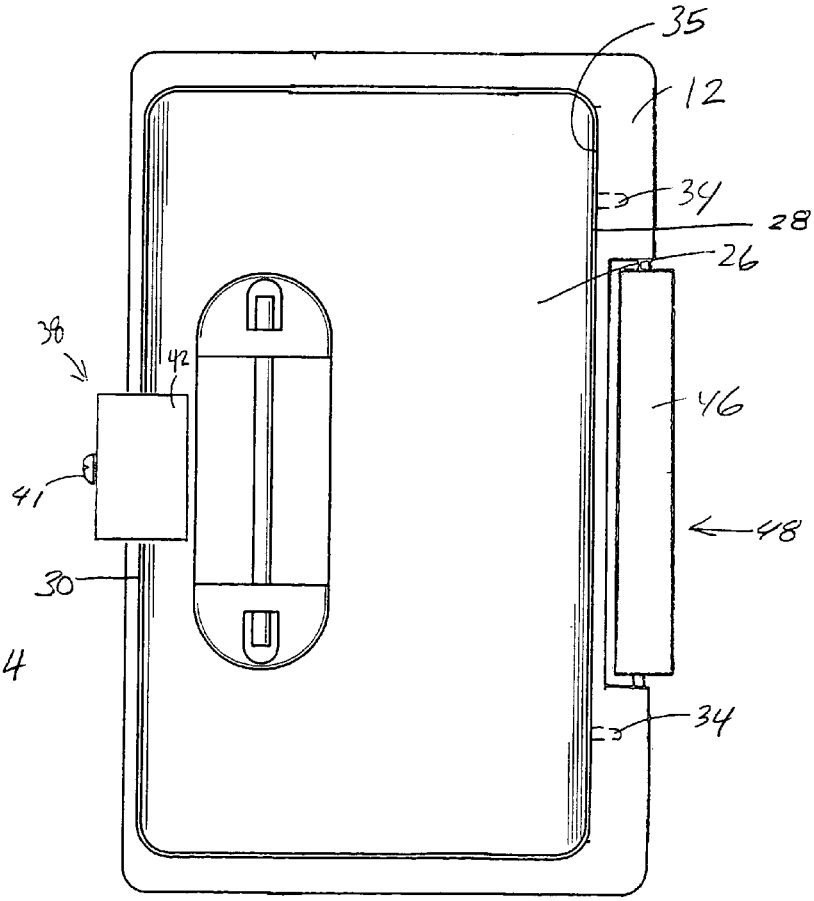
FIG. 4 shows a top view of the brush head of FIG. 3.
Figure 5:
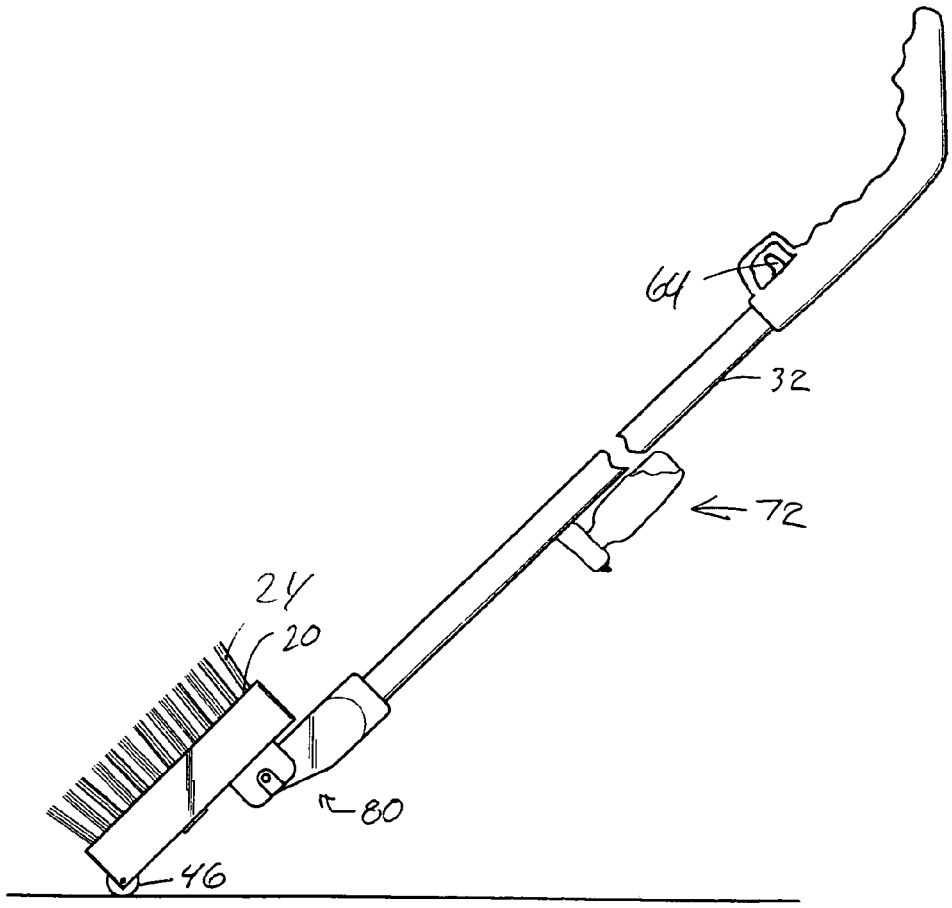
FIG. 5 shows the brush head of FIG. 1 pivoted forward onto the roller so the brush may be rolled across the floor.

In some embodiments, as shown in FIGS. 1-2, the first and second ends 28, 30 of the weight 26 are adjacent the laterally opposing ends 18 of the brush head 12. The support members 34, 36 and opposing support latch 38, being secured to the first and second ends 28, 30, are then also adjacent ends 18 of the brush head 12. In other embodiments, as shown in FIGS. 3-4, the first and second ends 28, 30 may instead be adjacent the leading and trailing ends 14, 16. The support members 34, 36 and support latch 38 are then adjacent the leading and trailing ends 14, 16.

The engagement member 44 typically comprises an upwardly projecting ridge 44 for engagement by a hand or foot. Dashed lines in FIG. 2 adjacent the support latch 38 illustrate the outward flexing of the support latch 38. The weight 26 is thus secured within the weight recess 22 by the male and female support members 34, 36 at the first end 28 and by the support latch 38 at the second end 30. Conversely, the weight 26 is removed from the weight recess 22 by flexing the support latch 38 outwardly and lifting up on the handle 32.

In less preferred embodiments (not shown) the male support member 134 includes the entire first end 28 of the weight 26, and the female support member 136 is a single support recess laterally receding into the interior wall 35 of the weight recess 22 for receiving the first end 28 of the weight 26. The brush head housing 22 would overhang the first end 28 of the weight 26. Although such a design may be conceptually more simple, the molding of the brush head housing would, in practice, be more complex.

The brush head 12 extends laterally outwardly of the roller 46. Preferably, as shown in the alternate embodiment of FIG. 6, a pair of laterally opposing outer body portions 50 extend laterally outward of the central body portion 48 and define the laterally opposing ends 18. The outer body portions 50 are vertically lower than the central body portion 48 to increase vertical clearance above the outer body portions 50 as compared with clearance above the central body portion 48. As shown, the outer body portions 50 taper downwardly toward the laterally opposing ends 18 to provide this increased clearance. In other embodiments (not shown), the outer body portions may instead "step-down" rather than taper-down from the central body portion 48. This clearance allow for cleaning in certain vertically-confined places, such as under kitchen cabinetry overhangs. Central placement of the roller 46 as shown is desirable, rather than outward placement, so the roller 46 does not interfere with this clearance and is not likely to get caught on cabinet overhang.

Figure 6:
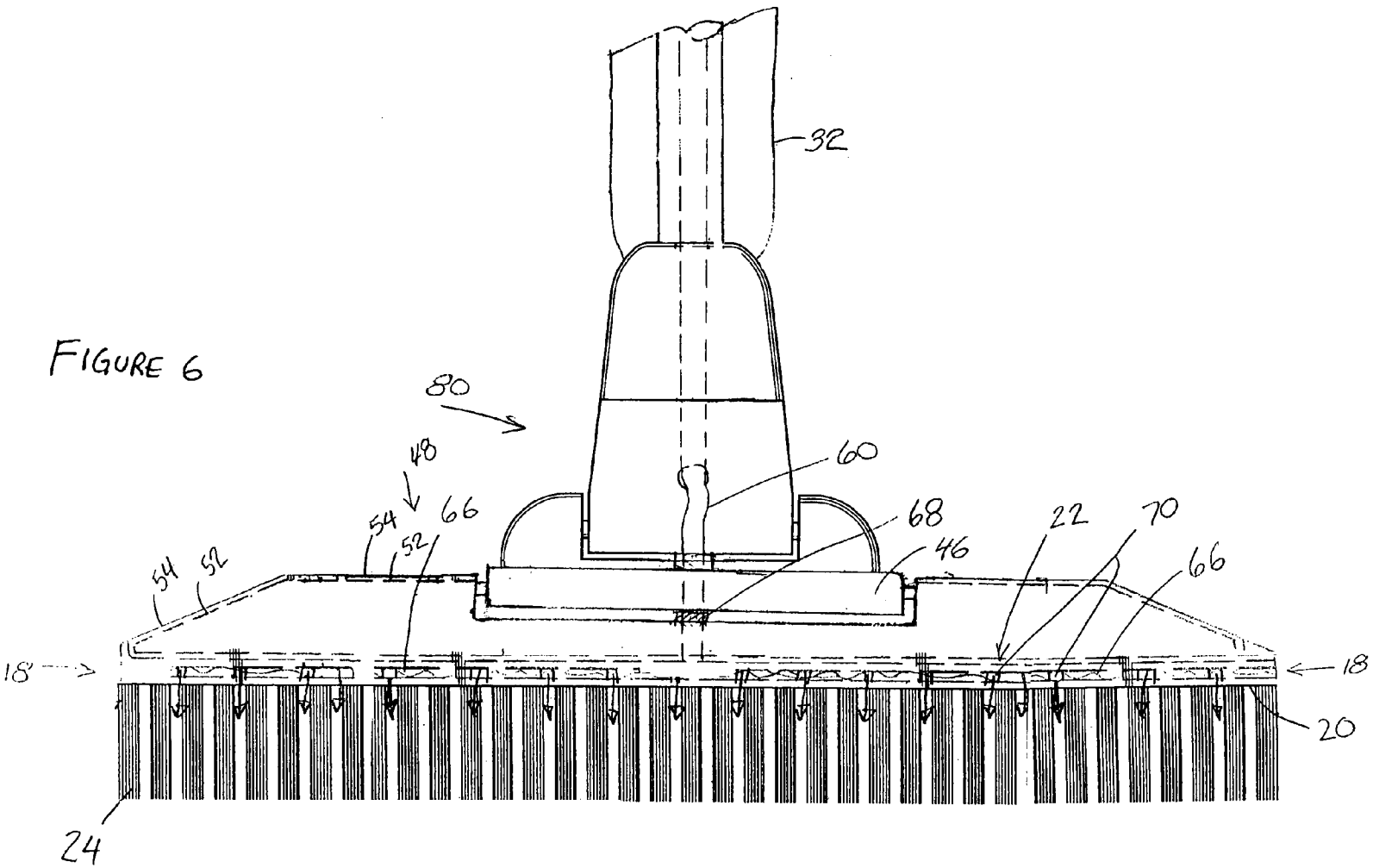
FIG. 6 shows a brush head having a pair of tapered, laterally opposing outer body portions with a similarly tapered weight.

In some embodiments, such as shown in FIG. 6, the weight recess 22 extends at least partially into the outer body portions 50 of the brush head 12, with the weight 26 tapering downwardly toward the laterally opposing ends 18 of the brush head 12. An upper surface 52 of the weight 26 is recessed fully within the weight recess 22, meaning that substantially all of the upper surface 52 is at least flush with or below an upper surface 54 of the brush head 12. The bristles 24 preferably extend laterally outwardly along the portion of the bristle support surface 20 underneath the laterally opposing outer body portions 50.

Preferred embodiments provide the option of supplying water or other fluid to the brush, to improve cleaning action. These embodiments include a liquid intake port 56 for connecting with a liquid supply 58, and a conduit 60 extending from the liquid intake port 56 to the brush head 12 to dispense liquid from the conduit 60 to the plurality of bristles 24. The liquid supply 58 may be connected to a fluid tank worn on the back of the brush operator. The liquid intake port 56 shown is a female hose-type connection, and the water supply 58 is the hose 58, which optionally may be connected to a tank worn on the back of the operator. As shown, the conduit 60 may pass through the handle 32 for convenience. Otherwise, the conduit 60 may be routed another way, such as by clamping the conduit 60 externally to the handle 32. The conduit 60 is optionally routed from the handle 32 through a portion of the pivot structure 80. A liquid valve 62 controls flow between the liquid supply 58 and the conduit 60. A trigger 64 may be secured to the handle 32 for operating the liquid valve 62.

To help distribute liquid from the conduit 60 to the bristles 24, a liquid distribution manifold 66 is included, having an input port 68 for receiving liquid from the conduit 60 and a plurality of laterally spaced output ports 70 for distributing liquid to the bristles 24 at different locations. The liquid distribution manifold 66 is contained within the brush head 12, and may be molded within the brush head 12. Alternatively, in other embodiments not shown, the manifold 66 may be secured to the underside of the brush head 12, such as to the downwardly facing bristle support surface 20.

To further assist the cleaning action of the brush 10, a chemical dispenser 72 is provided, including a dispenser port 74 in fluid communication with the conduit 60 and a chemical supply vessel 76 removably securable to the dispenser port 74. The chemicals, which may include cleaning agents or degreaser, are thereby mixed with the fluid, such as water, to assist cleaning. The dispenser port 74 can be a venturi port for dispensing chemicals in response to liquid flow through the conduit 60. A venturi port has the advantage that the chemical may flow only when needed, which is when liquid/water is flowing. Alternatively, a chemical valve 78 may be used for manually controlling flow between the chemical dispenser 72 and the conduit 60. Button 75 conceptually illustrates an embodiment of a control mechanism for controlling the chemical valve 78.

The chemical dispenser 72 is preferably secured to the handle 32, as shown in FIG. 1. Placement of the chemical dispenser 72 relatively low on the handle 32 may desirably lower the center of gravity of the brush 10. Placement higher on the handle 32, as shown, may alternatively position the chemical dispenser 72 closer to the user's hands, which is desirable if the dispenser 72 is manually operated, such as with chemical valve 78. If an "automatic" type valve or venturi port is included, it may not be necessary to place the chemical dispenser 72 nearer to the user's hands.

In less preferred embodiments the chemical dispenser 72 may instead be secured to the weight 26. This potentially provides additional useful weight to the brush head 12. This vertical orientation of the chemical dispenser 72 may also reduce stress on the chemical dispenser 72, and specifically on the dispenser port 74, as compared with the angled orientation of FIG. 1. Placement of the chemical dispenser 72 on the weight 26 or brush head 12 is generally not desirable, however, because it would likely interfere with passing the brush head 12 under low surfaces, such as under tables. Care must also be taken to give the chemical dispenser 72 a sufficiently low profile that it not hit the floor 5 when pivoted forward for rolling.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations, and modifications, including but not limited to those design alternatives specifically discussed herein, may be made in the practice of the invention without departing from its scope.

The invention claimed is:

1. A weighted scrub brush for scrubbing an upwardly facing surface, the weighted scrub brush comprising:

a brush head defining a leading end, a trailing end, a pair of laterally opposing ends, a downwardly facing bristle support surface, and an upwardly opening weight recess;

a plurality of bristles extending downwardly from the bristle support surface for contacting the upwardly facing surface;

a weight removably positioned within the weight recess, the weight defining first and second opposing ends;

a handle pivotally secured to one of the weight and the brush head;

a male support member on the first end of the weight or an interior wall of the weight recess and a female support member on the other of the first end of the weight or the interior wall of the weight recess for receiving the male support member, to secure the first end of the weight within the weight recess; and a cantilevered support latch having a fixed end secured to the brush head adjacent the second end of the weight, and a free end partially overlapping the second end of the weight to secure the second end within the weight recess.

2. A weighted scrub brush as defined in claim 1, further comprising:

an engagement member on the support latch spaced from the fixed end for flexing the support latch outwardly to move the free end of the latch away from the second end of the weight and remove the weight from the weight recess.

3. A weighted scrub brush as defined in claim 1, wherein the engagement member of the support latch comprises an upwardly projecting ridge for engagement by a hand or foot.

4. A weighted scrub brush as defined in claim 1, wherein the male support member includes one or more support projections laterally extending from the first end of the weight, and the female support member includes one or more support recesses laterally receding into the interior wall of the weight recess.

5. A weighted scrub brush as defined in claim 4, further comprising:

a liquid intake port for connecting with a liquid supply; and a conduit extending from the liquid intake port to the brush head to dispense liquid from the conduit to the plurality of bristles.

6. A weighted scrub brush as defined in claim 1, further comprising:

a roller secured to a central body portion of the brush head forward of the handle, the roller radially extending upwardly and outwardly from the leading end of the brush head, such that the brush head may be pivoted to a forward, inverted position to roll the brush, the brush head extending laterally outwardly of the roller.

7. A weighted scrub brush as defined in claim 1, wherein the brush head further comprises:

a pair of laterally opposing outer body portions extending laterally outward of a central body portion and defining the laterally opposing ends, the outer body portions being vertically lower than the central body portion to increase vertical clearance above the outer body portions.

* * * * *